United States Patent [19]

Hubby

[11] Patent Number: 4,909,037

[45] Date of Patent: Mar. 20, 1990

[54] CONTROL SYSTEM FOR ONCE-THROUGH BOILERS

[75] Inventor: Robert N. Hubby, Flourtown, Pa.

[73] Assignee: General Signal Corporation, Stamford, Conn.

[21] Appl. No.: 401,276

[22] Filed: Aug. 31, 1989

[51] Int. Cl.[4] ..... F01K 13/02

[52] U.S. Cl. ..... 60/664; 60/667; 122/448 S

[58] Field of Search ..... 60/664, 665, 667; 122/448 S

[56] References Cited

U.S. PATENT DOCUMENTS

| | | | |
|---|---|---|---|
| 3,545,207 | 12/1970 | Barber et al. | 60/664 X |
| 3,802,189 | 4/1974 | Jenkins, Jr. | 60/665 |
| 3,896,623 | 7/1975 | Daniels | 60/665 |
| 4,174,618 | 11/1979 | Jenkins, Jr. et al. | 60/664 |
| 4,213,304 | 7/1980 | Morse | 60/664 |

*Primary Examiner*—Allen M. Ostrager

*Attorney, Agent, or Firm*—William G. Miller, Jr.; Harold Huberfeld

[57] ABSTRACT

A control for the fuel input to a once-through boiler connected to supply steam through a throttle valve to a turbine-generator so that the rate of energy delivery to the boiler matches the rate of energy demand on the boiler as represented by demand signal. The fuel control involves comparing a demand signal indicative of the desired energy output rate for boiler with a signal indicative of the heat released to the furnace of the boiler and controlling the fuel input rate with a proportional and integral controller so that the fuel feed rate, such as coal feeder speed, is controlled so as to bring the signals into equality. The heat release signal is obtained by first calculating a lagged value of a quantity which corresponds to boiler output, such as steam flow or turbine first stage pressure, divided by fuel feed rate, such as feeder speed. That lagged quantity is then multiplied by a quantity corresponding to the value of the fuel feed rate.

10 Claims, 1 Drawing Sheet

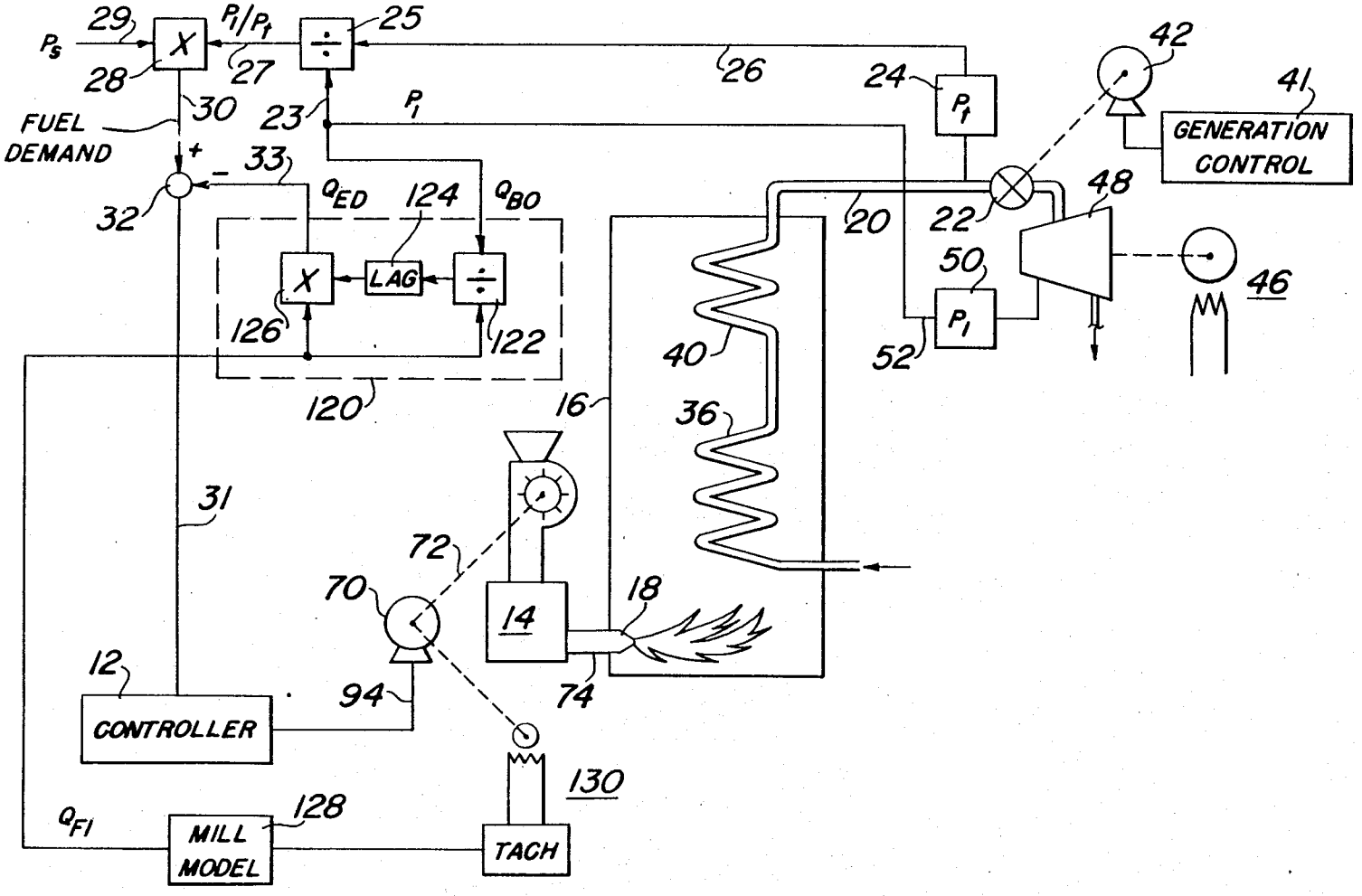
GENERATION CONTROL
41
42
46
48
22
50
52
24
20
26
40
36
18
74
16
14
130
TACH
72
70
94
128
MILL MODEL
CONTROLLER
12
31
$Q_{FI}$
$Q_{BO}$
122
124
LAG
126
120
$Q_{ED}$
$P_1$
25
23
33
27
30
$P_1/P_1$
29
28
$P_s$
FUEL DEMAND
32

CONTROL SYSTEM FOR ONCE-THROUGH BOILERS

BACKGROUND OF THE INVENTION

This invention relates to a control system for controlling boiler inputs in a once-through boiler so as to maintain the throttle pressure of the boiler at a desired value while maintaining the required steam flow to a load, such as a turbine-generator.

One of the most difficult problems that face the designer of control systems for fossil fuel boilers of the once-through type is the development of a fuel measurement that is adequate for meaningful control of the firing rate.

It used to be that utilities could depend on a single source of fuel supply for long periods of time. The absence of such dependable supplies along with the high cost of energy as well as increasingly stringent emission standards have forced utilities to obtain their fuel supplies from various sources depending on price and availability. Thus a constant heating value for any given fuel can no longer be assumed. This problem is further complicated by the industry shift back to coal firing which has always been subject to significant heating value variations. The problem of variable heating values exists for all fuels; however, the problem is particularly evident in coal fired systems.

In addition to the problem of changing heating values in coal delivery systems, these systems present other problems in that the fuel rate measurement typically doesn't reflect the actual coal flow to the furnace due to two main considerations: mill storage capacity and mill response capability. Mill coal flow is typically controlled by adjusting feeder speed, using a tachometer output to measure feeder speed and hence fuel input. All mills have significant capacity so that fuel flow into the mill does not necessarily represent the actual fuel flow going to the furnace of the boiler, let alone the BTU input to the boiler. Typical time constants for a mill may be in the range of 100 to 160 seconds before a change of mill input will be seen as a significant output to the furnace. These fuel delivery system dynamics may advantageously be taken care of with a "Mill Model" using feeder speed as its input. This model would typically have a dead time and a first order lag.

The difficulties created by trying to match fuel input energy required against actual energy delivered, particularly for those fuels with different heating values precipitated efforts of a coworker of mine to develop a method of balancing energy supply for a boiler with energy demand, regardless of the fuel service. A heat release calculation using turbine first stage pressure and rate of change of drum pressure was an integral part of a successful solution for matching energy supply to energy demand at the fuel controller for drum type boilers and resulted in U.S. Pat. No. 4,213,304, issued on July 22, 1980 to Richard H. Morse. That patent is hereby incorporated by reference into this application.

It is an object of this invention to provide a method and means for controlling a boiler of the once-through type in a manner similar to that which the referenced patent uses for drum type boilers by providing a novel signal representing the heat released to the furnace of the boiler.

SUMMARY OF THE INVENTION

In carrying out the present invention there is provided a method and means for controlling the fuel input to a once-through boiler connected to supply steam through a throttle valve to a turbine-generator so that the rate of energy delivery to the boiler matches the rate of energy demand on the boiler as represented by a demand signal. The method involves comparing a demand signal indicative of the desired energy output rate for the boiler with a signal indicative of the heat released to the furnace of the boiler and controlling fuel input rate with a proportional and integral controller so that the fuel feed rate is controlled to bring the signals into equality, just as was done in the referenced patent. The heat release signal for this invention, however, is different in that it is obtained by first calculating a lagged value of a quantity which corresponds to boiler output, such as steam flow or turbine first stage pressure, divided by fuel feed rate, as modeled by the fuel delivery system model including feeder speed and other fuel signals as applicable. That lagged value is then multiplied by the value of the fuel feed rate to obtain a signal equal to the steady state energy delivered to the furnace.

BRIEF DESCRIPTION OF THE DRAWINGS

The sole FIGURE shows a circuit diagram of an analog execution of the form of the invention, which corresponds to the showing of FIG. 1 of the referenced patent except for the showing of the boiler without a drum so as to represent a once-through boiler and the showing for that part of the circuit which generates the signal on line 33, whose elements are shown with reference characters exceeding the number 119.

DESCRIPTION OF THE PREFERRED EMBODIMENTS

In the referenced patent the heat release signal on line 33 is compared to the demand signal on line 30 to produce an error signal on line 31, and the fuel feed is controlled by controller 12 from that error signal so as to maintain the error signal at zero. In the present invention the controller operates in a like manner to keep the error signal at zero in order to maintain the BTU input to the boiler equal to the rate of energy output of the boiler while maintaining the throttle pressure at its set point. In the referenced patent the heat release signal was made up of the sum of a signal $P_1$, the turbine first stage pressure measurement, representing boiler output under steady state conditions, and a signal dP/dt representing the rate of change of the drum pressure and hence the rate at which stored energy is changing in the boiler.

Unfortunately, with once-through boilers there is no good index for stored energy, for there is no drum present, and it is difficult to find a measurement which will determine the energy stored in the boiler. Thus, with the once-through boiler the solution to the fuel measurement problem must be arrived at by improving the classical approaches that are normally used. The most important improvement is the automatic compensation of the total fuel signal for the actual rate of heat energy release. This is accomplished in accordance with the present system in the network 120 by computing with dividing network 122 the ratio of the steady state rate at which boiler output energy is being supplied to the total fuel feed rate to the boiler, $Q_{BO}/Q_{FI}$, where $Q_{BO}$ is the steady state rate of boiler output and $Q_{FI}$ is the total fuel feed rate. By using this ratio as a scaler on the total fuel measurement, the total fuel measurement that is used for control (the heat release signal $Q_{ED}$) will be equal to boiler output energy rate under steady state conditions.

The compensation is done by the present system without destabilizing the fuel feed control system, which includes both proportional and integral or reset control, by introducing the compensation gradually through the use of a first order lag circuit 124. By way of example, the rate at which the compensation is introduced should be a rate less than 1/10th the integration rate of the fuel controller 12. As shown in the figure, the output of the divider 122 is used as an input to the lag circuit 124 and the output of that lag circuit is then one of the inputs to the multiplier 126, the other input being the signal $Q_{FI}$ which is obtained from the output of the mill model 128.

The mill model 128 functions to characterize the fuel feed signal in accordance with the dynamic characteristics of the mill 14. Thus, the feeder speed, which is measured by connecting a tachometer 130 to the shaft of the feeder drive motor 70, is used as an input to the mill model which through the introduction of a dead time and a first order lag, for example, will characterize the feeder rate as represented by the signal from the tachometer to produce a fuel feed signal which closely matches the actual fuel feed provided at the output of the mill 14 to the furnace of the boiler. Thus, $Q_{FI}$, the output of the mill model, will closely match the actual fuel feed rate.

In the system of the figure, the boiler output signal $Q_{BO}$ is obtained by measuring the first stage pressure $P_1$ in the turbine 48. The boiler output could also be measured by measuring the steam flow, or by measuring the output of the generator 46.

In operation of the system of the figure, a load change such as would be signified by a change in the position of the throttle valve 22 to provide a change in the output of the generator 46 would cause a comparable change in the demand signal on line 30. As a result of such a change the controller would change the fuel input by changing the speed of motor 70 so as to maintain the signal on line 33 equal to that on line 30. Initially upon occurrence of such a load change, the output of the divider would respond to the change in $P_1$, but the output of the lag circuit 124 would not have changed thus leaving the value of the signal on line 33 unchanged except for the changes which occur in response to the control action of controller 12. Since the control action is faster than the lag circuit, the fuel feed will be controlled to meet the new load with a minimum of interaction from the network 120.

When there is a change in the heat value of the fuel without any change in load there will be a resulting change in the signals $P_1$ and $P_t$ which will tend to keep the demand signal on line 30 unchanged so that the response of the controller will be solely to the change in $P_1$ as it affects the network 120. Thus, the rate of fuel feed will be changed to compensate for the changed heat value and the heat released by the fuel to the boiler will be brought back into balance with the rate of energy output determined by the setting of the throttle valve 22.

While the system of the figure is shown as an analog system, it will be evident to those familiar with the measurement art that the same functions can be carried out by using a digital system.

What is claimed is:

1. The method for controlling the fuel input to a once-through boiler connected to supply steam through a throttle valve to a turbine-generator so that the rate of energy delivery to the boiler matches the rate of energy demand on the boiler as represented by a demand signal, said method comprising the steps of:

producing a demand signal indicative of the desired energy output rate for the boiler;

measuring a quantity $Q_{BO}$ indicative of the rate of energy output from the boiler;

measuring a quantity $Q_{FI}$ indicative of the rate of fuel feed to the boiler; and controlling the fuel input to the boiler with a controller providing proportional and integral control in response to an error signal calculated as the difference between said rate of energy demand and the product of a lagged value of a quantity $Q_{BO}/Q_{FI}$ and the value of $Q_{FI}$.

2. The method for controlling the fuel input to a once-through boiler connected to supply steam through a throttle valve to a turbine-generator so that the rate of energy delivery to the boiler matches the rate of energy demand on the boiler as represented by a demand signal, said method comprising the steps of:

measuring the first stage pressure of the turbine $P_1$ to provide a quantity $Q_BO$ indicative of the rate of energy output from the boiler;

measuring a quantity $P_t$ indicative of the actual throttle pressure of the boiler;

producing a quantity $P_s$ indicative of the desired throttle pressure of the boiler;

producing a demand signal indicative of the desired energy output rate for the boiler in accordance with a quantity calculated as $P_1(P_s/P_t)$;

measuring a quantity $Q_{FI}$ indicative of the rate of fuel feed to the boiler; and controlling the fuel input to the boiler with a controller providing proportional and integral control in response to an error signal calculated as the difference between said rate of energy demand and the product of a lagged value of a quantity $Q_{BO}/Q_{FI}$ and the value of $Q_{FI}$.

3. The method for controlling the fuel input to a once-through boiler connected to supply steam through a throttle valve to a turbine-generator so that the rate of energy delivery to the boiler matches the rate of energy demand on the boiler as represented by a demand signal, said method comprising the steps of:

producing a demand signal indicative of the desired rate of energy output from the boiler;

measuring a quantity $Q_{BO}$ indicative of the rate of energy output from the boiler;

measuring a quantity $P_t$ indicative of the actual throttle pressure of the boiler;

producing a quantity $P_s$ indicative of the desired throttle pressure of the boiler;

measuring a quantity $Q_{FI}$ indicative of the rate of fuel feed to the boiler;

producing a ratio quantity indicative of the value of $Q_{BO}/Q_{FI}$;

producing a lagged ratio quantity which represents a lagged value of said ratio quantity;

producing a quantity $Q_{ED}$ in accordance with the product of said lagged ratio quantity and the quantity $Q_{FI}$; and controlling the fuel input to the boiler with a controller providing proportional and integral control in response to an error signal calculated as the difference between said demand signal and the value of $Q_{ED}$.

4. The method of claim 3 in which the rate of change in said lagged ratio quantity is less than one tenth the rate of the integral response in said control.

5. The method of claim 3 in which the quantity $Q_{FI}$ is produced by using a model of the fuel feed mechanism in order that the quantity will closely follow the actual fuel feed to the boiler.

6. Apparatus for controlling the fuel input to a once-through boiler connected to supply steam through a throttle valve to a turbine-generator so that the rate of energy delivery to the boiler matches the rate of energy demand on the boiler as represented by a demand signal, comprising:

means for producing a demand signal indicative of the desired rate of energy output of the boiler;

means for producing a signal $Q_{BO}$ indicative of the measured rate of energy output from the boiler;

means for producing a signal $Q_{FI}$ indicative of the rate of fuel feed to the boiler;

means for producing from the signals $Q_{BO}$ and $Q_{FI}$ a ratio signal indicative of the value of $Q_{BO}/Q_{FI}$;

means for producing from the ratio signal a lagged ratio signal which represents a first order lag of said ratio signal;

means for producing a signal $Q_{ED}$ by multiplying said lagged ratio signal by the signal $Q_{FI}$; and means for controlling the fuel input to the boiler by means of a controller providing proportional and integral control, said control being in response to an error signal representing the deviation of the magnitude of the signal $Q_{ED}$ from said demand signal so as to vary the heat released in the boiler in such a way that the error signal will be maintained at zero.

7. Apparatus as set forth in claim 6 in which the means for producing the lagged ratio signal is such that the rate of change in said lagged ratio signal in response to a step change in said ratio signal is less than one tenth the rate of change in the response of said controller's integral action to a step change in the error signal.

8. Apparatus as set forth in claim 6 in which the signal $Q_{BO}$ is obtained by measuring the steam flow to the turbine.

9. Apparatus for controlling the fuel input to a once-through boiler connected to supply steam through a throttle valve to a turbine-generator so that the rate of energy delivery to the boiler matches the rate of energy demand on the boiler as represented by a demand signal, comprising:

means for producing a signal $Q_{BO}$ indicative of the measured rate of energy output from the boiler by measuring the first stage pressure of the turbine;

means for producing a signal $P_t$ indicative of the actual throttle pressure of the boiler;

means for producing a signal $P_s$ indicative of the desired throttle pressure of the boiler;

means for producing a demand signal indicative of the desired rate of energy output of the boiler in accordance with the quantity $P_1(P_s/P_t)$;

means for producing a signal $Q_{FI}$ indicative of the rate of fuel feed to the boiler;

means for producing from the signals $Q_{BO}$ and $Q_{FI}$ a ratio signal indicative of the value of $Q_{BO}/Q_{FI}$;

means for producing from the ratio signal a lagged ratio signal which represents a first order lag of said ratio signal;

means for producing a signal $Q_{ED}$ by multiplying said lagged ratio signal by the signal $Q_{FI}$; and means for controlling the fuel input to the boiler by means of a controller providing porportional and integral control, said control being in response to an error signal representing the deviation of the magnitude of the signal $Q_{ED}$ from said demand signal so as to vary the heat released in the boiler in such a way that the error signal will be maintained at zero.

10. The method for controlling the boiler outlet pressure of a fuel fired, once-through boiler connected to supply steam through a throttle valve to a turbine-generator, which comprises the steps of:

measuring a quantity $Q_{BO}$ indicative of the rate of energy input to the turbine;

measuring a quantity $P_t$ indicative of the actual throttle pressure;

providing a quantity $P_s$ indicative of the desired throttle pressure;

measuring a quantity $Q_{FI}$ indicative of the fuel feed rate;

controlling the fuel input to the boiler with a controller providing proportional and integral control in response to an error signal corresponding to the difference between a heat release signal calculated as a lagged value of a quantity $Q_{BO}/Q_{FI}$ times the value of $Q_{FI}$ and a demand signal calculated as $Q_{BO}(P_s/P_t)$.

* * * * *